US008502750B2

(12) United States Patent
Thebault et al.

(10) Patent No.: US 8,502,750 B2
(45) Date of Patent: Aug. 6, 2013

(54) METHOD FOR DRIVING A PLASMA DISPLAY PANEL WITH ATTENUATION EXTIMATION AND COMPENSATION AND CORRESPONDING APPARATUS

(75) Inventors: Cédric Thebault, Villingen-Schwenningen (DE); Carlos Correa, Villingen-Schwenningen (DE); Sébastien Weitbruch, Kappel (DE)

(73) Assignee: Thomson Licensing, Issy-les-Moulineaux (FR)

( * ) Notice: Subject to any disclaimer, the term of this patent is extended or adjusted under 35 U.S.C. 154(b) by 1249 days.

(21) Appl. No.: 11/707,417

(22) Filed: Feb. 16, 2008

(65) Prior Publication Data

US 2009/0009502 A1 Jan. 8, 2009

(30) Foreign Application Priority Data

Feb. 20, 2006 (EP) ..... 06290293

(51) Int. Cl.
*G09G 3/28* (2013.01)

(52) U.S. Cl.
USPC ..... 345/63

(58) Field of Classification Search
USPC ..... 345/60–72
See application file for complete search history.

(56) References Cited

U.S. PATENT DOCUMENTS

| | | | | |
|---|---|---|---|---|
| 4,860,103 | A * | 8/1989 | Azam et al. | 348/572 |
| 5,757,343 | A | 5/1998 | Nagakubo et al. | |
| 7,009,627 | B2 * | 3/2006 | Abe et al. | 345/690 |
| 7,191,402 | B2 * | 3/2007 | Kim et al. | 715/723 |
| 7,542,031 | B2 * | 6/2009 | Jo et al. | 345/211 |
| 7,649,510 | B2 * | 1/2010 | Baek | 345/63 |

FOREIGN PATENT DOCUMENTS

| | | |
|---|---|---|
| EP | 1 139 322 A | 10/2001 |
| JP | 2006030265 | 2/2006 |

OTHER PUBLICATIONS

Search Report Dated Jun. 9, 2006.

* cited by examiner

*Primary Examiner* — Bipin Shalwala
*Assistant Examiner* — Steven Holton
(74) *Attorney, Agent, or Firm* — Myers Wolin, LLC

(57) ABSTRACT

The picture quality on a plasma display panel shall be improved when the contrast and/or the brightness are reduced. This is achieved by estimating the reduction of the dynamic occurring in the front-end of the data processing of the plasma display device and by compensating it in the back-end. Specifically, the gain and/or offset of the video input data are adjusted and the power level of the adjusted video data is measured. The resulting power level information is updated on the basis of an attenuation information. The updated power level is used for the power management and the level of the video data being reduced in the front-end is increased on the basis of the attenuation information. Thus, the dynamic of the video and, as a result, the picture quality are improved.

9 Claims, 4 Drawing Sheets

METHOD FOR DRIVING A PLASMA DISPLAY PANEL WITH ATTENUATION EXTIMATION AND COMPENSATION AND CORRESPONDING APPARATUS

This application claims the benefit, under 35 U.S.C. §119 of European Patent Application 06290293.7 filed Feb. 20, 2006.

FIELD OF THE INVENTION

The present invention relates to a method for driving a plasma display panel by providing video data, adjusting the gain and/or the offset of the video data, processing the video data on the basis of power level information and controlling the plasma display panel respectively. Furthermore, the present invention relates to a corresponding apparatus for driving a display panel.

BACKGROUND OF THE INVENTION

A PDP (plasma display panel) uses a matrix array of discharge cells, which can only be "ON", or "OFF". Also unlike a CRT (cathode ray tube) or LCD (liquid crystal display) in which gray levels are expressed by analog control of the light emission, a PDP controls the gray level by modulating the number of light pulses per frame (sustain pulses). This time-modulation will be integrated by the eye over a period corresponding to the eye time response. Since the video amplitude is portrayed by the number of light pulses, occurring at a given frequency, more amplitude means more light pulses and thus more "ON" time. For this reason, this kind of modulation is also known as PWM, pulse width modulation.

For all displays using pulse width modulation, the number of real gray levels is limited. For PDP, in case of standard coding the number of gray levels is more or less equal to 256.

These various gray levels can only be used when the dynamic of the input picture is at its maximum (in case of 8 bit signal, video values between 0 and 255). In other cases, when the dynamic is reduced (in particular because of contrast or brightness parameters), the number of displayed levels will further decrease.

The problem is that the picture quality is affected when the number of displayed levels is reduced.

Unfortunately, when reducing the contrast (by dividing by a certain factor) and/or the brightness (subtracting a certain coefficient from the picture), the maximum value of the picture decreases and so the picture quality is reduced.

Contrast and brightness controls are usually part of the so called "front-end", while PDP specific functions (gamma function, Sub-field encoding, etc) are part of the so called "back-end" of the display (see FIG. 3).

In the back-end of a PDP an APL function is used to control the power. The computation of this Average Power Level (APL) is made through the following function:

$$APL(I(x, y)) = \frac{1}{C \times L} \cdot \sum_{x,y} I(x, y)$$

where I(x,y) represents the picture to display, C the number of columns and L the number of lines of the PDP.

The aim of power management is to keep the power consumption constant (see FIG. 1) and to have a peak luminance as high as possible. So for every APL value, the maximal number of sustain pulses to be used is fixed. This number of sustain pulses decreases when the APL increases, and vice versa as shown in FIG. 2.

In peak-white pictures (low APL at the left side of FIG. 2), the number of sustain pulses is not limited by the power consumption, but by the available time for sustaining. For this reason, the power consumption of peak-white pictures will be lower than for the other pictures. Consequently, also the power consumption decreases for low APL levels (compare FIG. 1).

The following table shows an allocation of the values of the number of sustain pulses to the average power levels according to FIG. 2.

| APL | Total Number of sustain pulses |
|---|---|
| 0 | 1000 |
| 1 | 1000 |
| 2 | 1000 |
| 3 | 1000 |
| 4 | 1000 |
| 5 | 1000 |
| . | |
| . | |
| . | |
| 50 | 1000 |
| 51 | 1000 |
| 52 | 1000 |
| 53 | 1000 |
| 54 | 1000 |
| 55 | 1000 |
| 56 | 999 |
| 57 | 998 |
| 58 | 996 |
| 59 | 994 |
| 60 | 991 |
| 61 | 988 |
| 62 | 984 |
| 63 | 979 |
| 64 | 975 |
| 65 | 971 |
| 66 | 966 |
| 67 | 962 |
| 68 | 958 |
| 69 | 954 |
| 70 | 950 |
| 71 | 946 |
| 72 | 942 |
| 73 | 938 |
| 74 | 933 |
| 75 | 929 |
| . | |
| . | |
| . | |
| 295 | 449 |
| 296 | 448 |
| 297 | 447 |
| 298 | 446 |
| 299 | 445 |
| 300 | 444 |
| 301 | 442 |
| 302 | 441 |
| 303 | 440 |
| 304 | 439 |
| 305 | 438 |
| . | |
| . | |
| . | |
| . | |
| . | |
| 600 | 225 |
| 601 | 224 |
| 602 | 223 |
| 603 | 223 |

-continued

| APL | Total Number of sustain pulses |
|---|---|
| 604 | 222 |
| 605 | 222 |
| 606 | 221 |
| 607 | 221 |
| 608 | 221 |
| 609 | 220 |
| 610 | 220 |
| 611 | 219 |
| 612 | 219 |
| 613 | 219 |
| 614 | 218 |
| 615 | 218 |
| . . . | |
| 1005 | 102 |
| 1006 | 102 |
| 1007 | 102 |
| 1008 | 102 |
| 1009 | 102 |
| 1010 | 102 |
| 1011 | 101 |
| 1012 | 101 |
| 1013 | 101 |
| 1014 | 101 |
| 1015 | 101 |
| 1016 | 101 |
| 1017 | 100 |
| 1018 | 100 |
| 1019 | 100 |
| 1020 | 100 |
| 1021 | 100 |
| 1022 | 100 |
| 1023 | 100 |

As indicated above, the problem of the standard implementation of power management is that when the energy of the input picture of the back-end decreases, the number of sustain pulses increases. So the energy of the displayed picture decreases hardly.

FIG. 3 shows a principle block diagram of the driving unit of a plasma panel 1. The video input signal is first processed in the front-end 2. The front-end includes a scaling unit 4 for adapting the size of the picture to that of the panel. The scaled input signal is supplied to a brightness/contrast control block 5. This control block 5 receives external signals for tuning the brightness and/or the contrast of the picture (=adjusting the gain and/or the offset of the video data). The video signal is processed accordingly and supplied to the back-end 3. Within the back-end 3 the signal is processed in a usual path including a gamma block 6, a dithering block 7 and an encoding block 8. The gamma block 6 performs a data transformation with a look up table in accordance to a nearly quadratic gamma function. The output signal of the gamma block 6 is transmitted to the dithering unit 7 which will add for example 4 bit dithering in order to render more discrete video levels at the output. Afterwards, the sub field encoding 8 generates sub field data for the video signal. The resulting sub field data are sent to the plasma panel 1.

In a parallel path within the back-end 3 the output signal of the front-end 2 is input into an APL measurement block 10. This block supplies an APL level of the brightness/contrast tuned video signal to the power management 9. The power management 9 controls the gamma unit 6 and the encoding unit 8. Furthermore, the power management 9 delivers sustain information to the plasma panel 1.

With this arrangement, it is for example interesting to see what happens when the user is decreasing the contrast and/or the brightness.

When decreasing the contrast and/or the brightness, the APL (measured in the back-end 3) is decreasing; this means that the number of sustain pulses is increasing. This increases partly the contrast.

For example, the user wants to reduce the contrast by 2 for a picture, which has an APL of 300 (10 bit value). So originally this picture has in average approximately 444*300/1024=130 sustain pulses/cell, and can have a peak luminance of 444 sustain pulses (compare table shown above).

To obtain in average 65 sustain pulses/cell, the user in fact has to reduce the contrast of the picture by around 4. (for an APL value of 70, according to the table, the average number of sustain is equal to 950*70/1024=65). The peak luminance in this case is also reduced since all brightness levels of the whole picture are divided by more than 4, the maximum value of the picture will not be higher than 255/4.3=60 (this represents 950/4.3=222 sustain pulses). But since, the picture is divided by more than 4, the number of gray levels really used is also divided by around 4. The picture quality is rather low in this case.

SUMMARY OF THE INVENTION

In view of that, it is the object of the present invention to provide a driving apparatus for a plasma display panel which improves the picture quality, when the brightness and contrast of the picture are reduced. Furthermore, a respective method shall be provided.

According to the present invention this object is solved by a method for driving a plasma display panel by providing video input data, providing attenuation information, adjusting the gain and/or the offset of the video input data in order to obtain adjusted video data, measuring a power level of said adjusted video data and providing a respective first power level information, generating a second power level information on the basis of said first power level information and said attenuation information, changing the level of said adjusted input data on the basis of the attenuation information and obtaining respective changed video data, adjusting the number of sustain pulses per sub-field on the basis of said second power level information and, driving said plasma display panel with said adjusted number of sustain pulses and said changed video data.

Furthermore, according to the present invention there is provided an apparatus for driving a plasma display panel including brightness/contrast control means for receiving video input data, for adjusting the gain and/or the offset of the video input data and for outputting adjusted video data, attenuation data means for providing attenuation information, power measurement means for measuring a power level of said adjusted video data and providing a respective first power level information, power level generating means for generating a second power level information on the basis of said first power level information and said attenuation information, compensating means for changing the level of said adjusted input data of said brightness/contrast control means on the basis of the attenuation information and for outputting respective changed video data, power management means for adjusting the number of sustain pulses per sub-field on the basis of said second power level information and driving said plasma display panel with said adjusted number of sustain pulses and said changed video data.

According to a specific embodiment of the present invention the attenuation information directly depends on the adjustment of the gain and/or the offset of the video input data. Thus, attenuation evaluation means are not necessary in the back-end, since the attenuation information is directly produced in the front-end by the brightness/contrast control means for example.

Alternatively, the attenuation information may be evaluated during the step of adjusting the gain and/or the offset of the video input data, whereby the video input data are pre-given maximum input data. In this case, the implementation of the system would be simplified.

Preferably, the attenuation information may be evaluated during a blanking time between video frames. Thus, the blanking time can be used for adjusting the power management in the back-end.

Furthermore, component attenuation information may be evaluated for the red, green and blue components of the adjusted video data and the component attenuation information corresponding to the less attenuated component is used as the attenuation information. Such differentiation of the components leads to an improved colour rendition.

Preferably, the attenuation information is evaluated for each frame of the video input data. This guarantees a dynamic improvement for each picture.

BRIEF DESCRIPTION OF THE DRAWINGS

The present invention will now be explained in more detail along with the attached Figures, showing in.

DETAILED DESCRIPTION OF PREFERRED EMBODIMENTS

Figure 1:
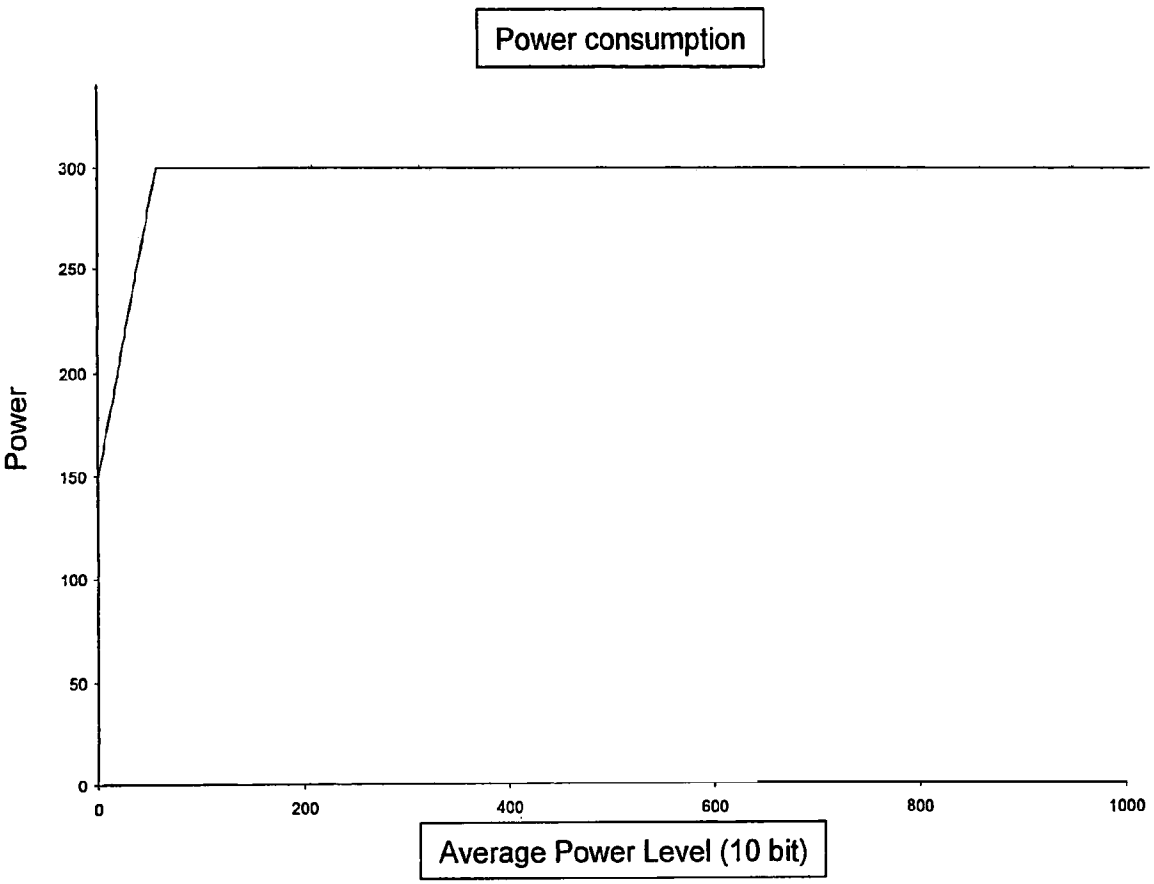
FIG. 1 a diagram of the power consumption over the average power level.
Figure 2:
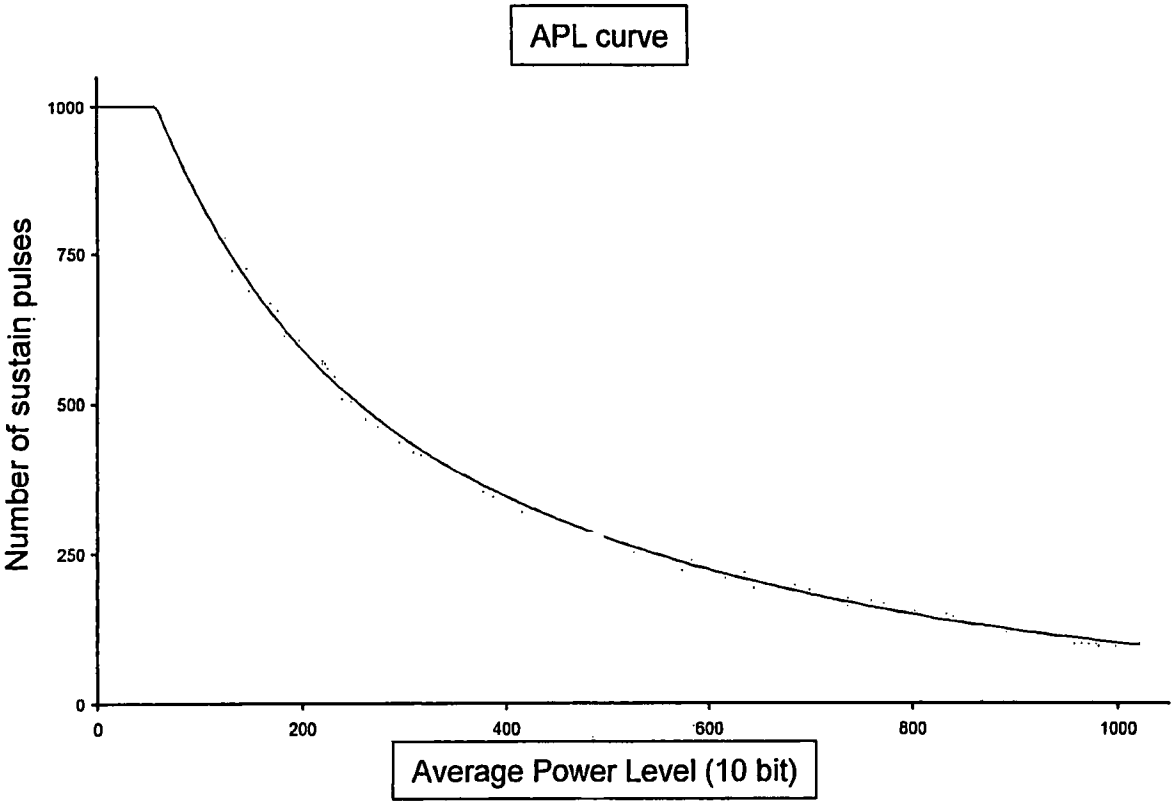
FIG. 2 a diagram of the number of sustain pulses over the average power level.
Figure 3:
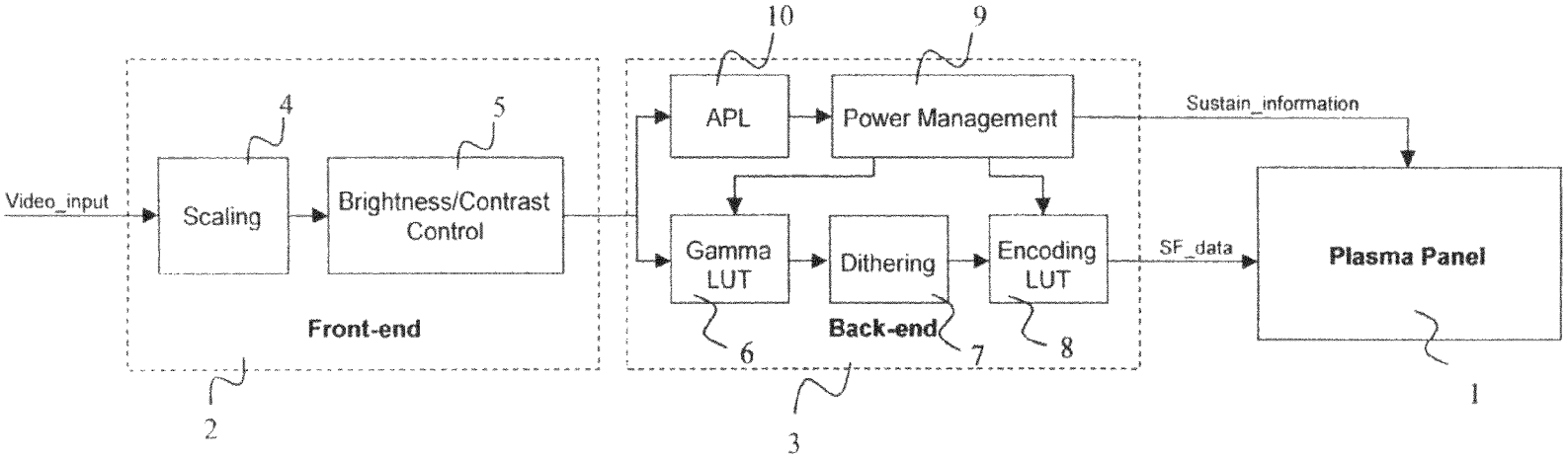
Fig. 3 prior art
FIG. 3 a block diagram of a driving unit of a plasma display panel according to the prior art, and FIG. 4 a diagram of a driving unit of a plasma panel according to the pre-sent invention.

The purpose of the invention presented here is to improve the behavior of the power management 9 (cf. FIG. 3) regarding contrast and brightness control.

The idea is that when contrast and/or brightness decrease, the power management should not increase the number of sustain pulses. Otherwise, the user needs to further decrease the contrast and/or the brightness, thereby further reducing the picture quality. The total number of sustain pulses should preferably decrease.

Figure 4:
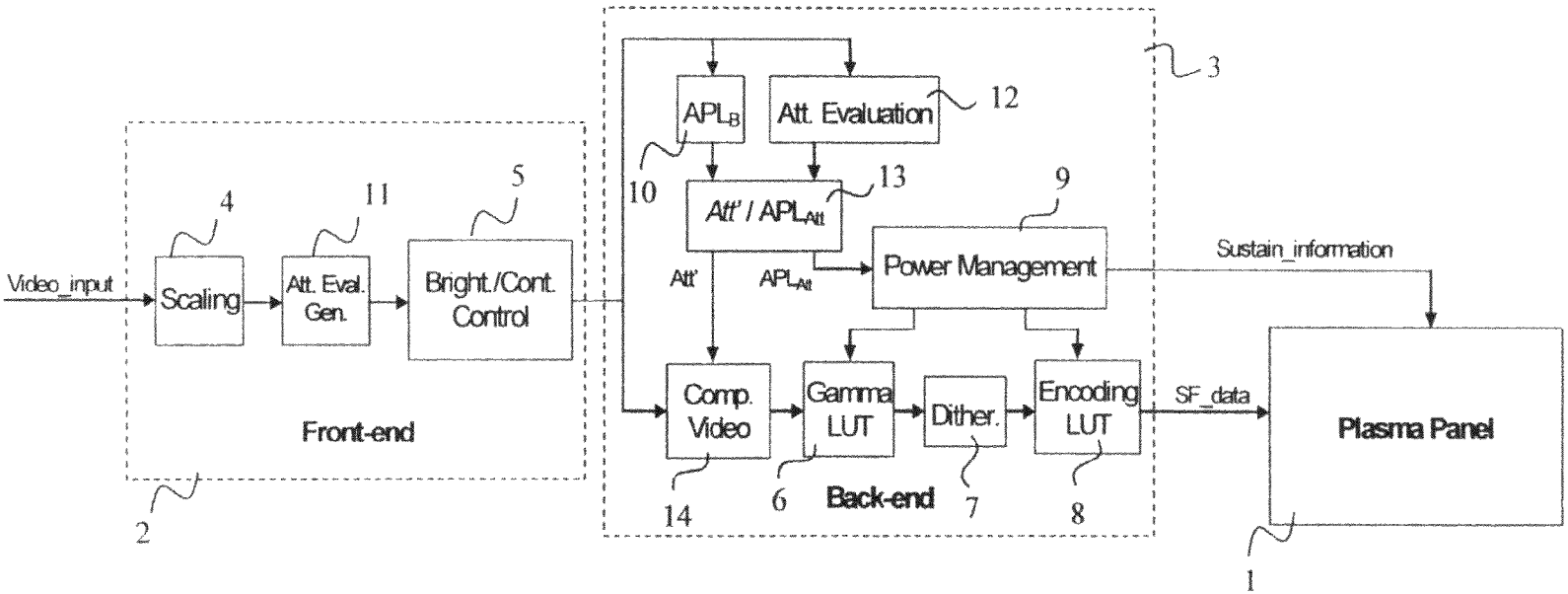

So the solution is to estimate the reduction of the dynamic occurring in the front-end 2, and to compensate it in the back-end 3 as shown in FIG. 4. The global structure of the block diagram of FIG. 4 is the same as the one shown in the block diagram of FIG. 3. However, some gray blocks are additionally included into the front-end portion 2 and the back-end portion 3. Block 11 only comes to effect if an attenuation value or attenuation information has to be evaluated, preferably during the blanking time explained below.

For evaluating an attenuation value, an attenuation evaluation generator 11 is connected in front of the brightness/contrast control block 5 as shown in FIG. 4. The attenuation evaluation generator 11 inputs into block 5 maximum video input data as reference data, on the basis of which the attenuation shall be evaluated. In the back-end 3 an attenuation evaluation unit 12 calculates the attenuation of the maximum input data tuned by the brightness/contrast control means 5. A respective attenuation factor or attenuation information is provided for a power level generating block 13 which provides an adapted power level information $APL_{Att}$ for the power management unit 9. This adapted power level information $APL_{Att}$ is generated on the basis of the attenuation information of block 12 and the power level measured by the power level measurement block 10 of the back-end 3. Furthermore, a modified attenuation information Att' is input to a compensation unit 14, which processes the video data of the brightness/contrast control means 5 of the front-end 2 and outputs compensated video data having increased dynamic to the gamma block 6. In the following, the function of the circuit of FIG. 4 is explained in more detail.

To evaluate the reduction of the dynamic, the front-end 2 includes the attenuation evaluation generator 11 in order to be able to deliver an output value for an input value corresponding to the maximum input value (1023 for R, G and B in case of 10 bit signal). These values ($R_{Att}$, $G_{Att}$, $B_{Att}$) should be evaluated during the blanking time.

Since it is not intended to modify the color changes made in the front-end, the same compensation 13 will be applied to the three components R, G, B. So in order to have no saturation, the coefficient, which will be used for the compensation will correspond to the less attenuated component. This means that only the less attenuated component will be fully compensated.

So the back-end 3 will only use the maximum of the values ($R_{Att}$, $G_{Att}$, $B_{Att}$) to determine the value of the compensation to apply. This maximum value has to be evaluated for each frame since the contrast and/or the brightness can change at any time.

Then regarding this maximum value (Att) and the value of the APL measured in the back-end 3 ($APL_B$), a new APL value $APL_{Att}$ is chosen with the help of a Look-Up Table: comp_APL. The total number of sustain pulses of the new APL value ($APL_{Att}$) corresponds to the total number of sustain pulses of $APL_B$ compensated for the value Att. If Att is encoded with 10 bits:

$$SustainNumber(APL_{Att}) = \mathrm{Max}\left(MinSustainNumber,\ SustainNumber(APL_B)\times\left(\frac{Att}{1023}\right)^{\gamma}\right)$$

MinSustainNumber corresponds to the total number of sustain pulses when the APL is maximum, i.e. MinSustainNumber=SustainNumber(APL_max) and γ corresponds to the gamma used in the Gamma LUT 6. This is done to reduce the total number of sustain pulses.

The compensation has to take into account the fact that the new APL value, $APL_{Att}$, is limited by the maximum value of APL. This can be done by another LUT: Att2Att'.

$$Att' = 1023\times\sqrt[\gamma]{\frac{SustainNumber(APL_{Att})}{SustainNumber(APL_B)}}$$

The inputs of this LUT will be the same as the inputs of comp_APL: $APL_B$ and Att since $APL_{Att}$ is a function of $APL_B$ and Att.

Then the video level has to be increased to compensate the reduction of the total number of sustain pulses. This can be done:

either by a multiplication by a coefficient, mult, located in a LUT (mult_video)

$$mult = 1024 \times \frac{1023}{Att'}$$

wherein the mult_video LUT has only Att' for input and $$VideoOut = \frac{VideoIn \times mult}{1024}$$

to be evaluated in the IC of the front-end 2 and/or the back-end 3, or by a LUT (comp_video)

$$VideoOut = 1023 \times \frac{VideoIn}{Att'}$$

wherein this LUT uses Att' and VideoIn as inputs.

This LUT only needs to be defined for VideoIn comprised between 0 and Att', since the maximum value at the input of the front-end gives at maximum Att at the output of the front-end (and so at the input of the back-end), and Att≦Att'.

As seen previously, this solution is based on LUTs. Usually, they need to be on an external memory (EPROM or Flash) and only in the case of the multiplication made by LUT, one (a subpart of comp_video) needs to be loaded in the on-chip memory of the IC.

The content of the front-end 2 and the back-end 3 of the example of FIG. 4 are only given as examples. It is only mandatory in the front-end 2 to have the "Attenuation Evaluation Generator" function 11 before the brightness/contrast control 5. Of course also another function that could increase or decrease the video level can be used.

At a given time of the blanking time, the "Attenuation Evaluation Generator" 11 should give as input to the front-end 2 the maximum value for R, G and B. Then, the "Attenuation Evaluation" 12 should read the output values of the front-end 2 during this time. During the remaining time of the frame, the "Attenuation Evaluation Generator" 11 should have a bypass function.

After having read the output values of the front-end 2 ($R_{Att}$, $G_{Att}$, $B_{Att}$), the "Attenuation Evaluation" 12 should evaluate the less attenuated value (Att) by computing the maximum of these three values ($R_{Att}$, $G_{Att}$, $B_{Att}$).

Then, using this value, Att, and the APL value, $APL_B$, the "Att'/$APL_{Att}$" block 13 will pick-up in the Look-Up Tables (comp_APL and Att2Att') located in the external memory the value of the attenuated APL, $APL_{Att}$, and the new value of the attenuated value, Att' which only differs from Att when $APL_{Att}$=1023. These two LUTs have the same inputs (Att and $APL_B$) and the same size: 1024*1024*10 bit, if each value uses 10 bits. These values are only read once per frame, and so the LUTs can typically be stored in the external memory.

The value $APL_{Att}$ will be used by the Power Management 9 to choose the correct sustain information sent to the PDP, and to load the corresponding LUTs in the Gamma 6 and Decoding blocks.

The value Att' is used by the Compensation Video Block 14. This block 14 can be defined:

either to use a multiplication by a coefficient, mult. In this case, this coefficient is picked-up in the LUT (mult_video) located in the external memory.

$$mult = 1024 \times \frac{1023}{Att'}$$

This mult_video LUT has only one input (Att'), and its size is 1024*16 bit (in case of 10 bit signals). Then the following expression has to be computed (this is only a 10 bit×16 bit multiplication and a bit shift)

$$VideoOut = \frac{VideoIn \times mult}{1024}$$

or to load at the beginning of the frame a subpart of the comp_video LUT located in the external memory. This comp_video LUT has a size of 1024*512*10 bit (in case of 10 bit signals). The first input is Att' and the second one is the video coming from the front-end. This LUT is only defined for a video input value comprised between 0 and Att', that's why its size is 1024*512*10 bits and not 1024*1024*10 bits.

This sub-part of the comp_video LUT, which has a maximum size of 1024*10 bit, has to be loaded in the IC for each frame.

This solution does not change the brightness on the PDP. In fact it decreases the total number of sustain pulses but it increases in the same ratio the video values R, G, B. On the PDP there will be used as many sustain pulses as before, only the number of unused sustain pulses will be smaller. This means that, advantageously, the power consumption will be reduced in this case.

Coming back to the example of the introductory part of the description. The user wants to reduce the contrast by 2. As previously seen, it is necessary to divide the video level by around 4.3 (after gamma correction).

During the blanking, the "Attenuation Evaluation Generator" 11 and the "Attenuation Evaluation" functions 12 will evaluate the attenuation: the "Attenuation Evaluation Generator" block 11 sends 1023 on the three components, and the "Attenuation Evaluation" block 12 reads $$528 = \left(\frac{1023}{\sqrt[\gamma]{4,3}}\right)$$

for the three components ($R_{Att}$, $G_{Att}$, $B_{Att}$) since in this example (with γ=2.2) the front-end 2 applies the same process on the three components. So the maximum of these three values leads to: Att=528.

The measurement of the APL 10 in the back-end 3 leads to $APL_B$=70.

The Look-up Table comp_APL located in the external memory gives for the given values of Att (528) and $APL_B$ (70), a new value of APL, $APL_{Att}$, in block 13. This new APL has 4.3 times less sustain than $APL_B$. So since SustainNumber (70)=950, SustainNumber($APL_{Att}$)=222 and $APL_{Att}$=605.

Then an updated value of Att is looked up in the LUT Att2Att'. Here the value is the same: Att'=528.

Depending on the choice which has been made for the implementation, a LUT or just a coefficient has to be loaded in the IC in order to proceed to the multiplication.

So in the first case, the Compensation Video Block 14 will pick-up the LUT corresponding to Att'=528 in the comp_video LUT located in the external memory. This LUT has only 528 inputs since the front-end delivers values between 0 and $$528\left(\frac{0}{\sqrt[\gamma]{4.3}} \text{ to } \frac{1023}{\sqrt[\gamma]{4.3}}\right)$$

even if the place on this IC should be equal to its maximum size, i.e. 1024*10 bit. This LUT is loaded only once per frame, and is used for every pixel of the picture. The LUT will multiply the video data by $$\sqrt[\gamma]{4.3},$$

so that the video will be able to use the full dynamic of the PDP.

The other solution is to make this multiplication in the IC. In this case only the coefficient to be used for the multiplication (mult) has to be loaded in the IC. This coefficient is in the mult_video LUT located in the external memory. This value is loaded only once per frame, and is used for every cell of the picture. The entry to this LUT is Att'=528, and the output is $$mult = 1024 \times \frac{1023}{Att'} = 1984.$$

Then, for every cell of the panel 1, the following multiplication has to be computed:

$$VideoOut = \frac{VideoIn \times 1984}{1024}$$

$$\left(\frac{1984}{1024} \approx \sqrt[\gamma]{4.3}\right)$$

The power management unit 9 uses the value 605 as input. The average number of sustain pulses is equal to 222*(70*4.3)/1024=65, but the maximum value of the picture will be $$528 \times \sqrt[\gamma]{4.3} = 1023.$$

So the picture is able to use the same number of levels than before the reduction of contrast.

This means that the number of gray levels really used is four times as big as in the standard implementation. So finally the picture quality is significantly improved.

The invention claimed is:

1. A method for driving a plasma display panel, comprising:

providing video input data to a brightness or contrast control module for respectively adjusting the gain or the offset of the video input data in said brightness or contrast control module in order to obtain adjusted video data in front of a power management module providing a number of sustain pulses applied to the plasma display panel, wherein said adjusted video data are applied to a compensating module for changing the level of said adjusted video data and are applied to an attenuation evaluation unit for calculating the attenuation of predetermined input video data tuned by the brightness or contrast control module to provide attenuation information representative of the attenuation provided by said brightness or contrast control module, to provide control signals to reduce the number of sustain pulses according to said tuning of predetermined input video data by the brightness or contrast control module and to increase the level of said adjusted video data according to the reduced number of sustain pulses for driving said plasma display panel with reduced power consumption and improved picture quality.

2. The method according to claim 1, wherein the attenuation information is generated when adjusting the gain or the offset of the video input data.

3. The method according to claim 1, wherein said attenuation information is evaluated after said adjusting the gain or the offset of the video input data, whereby pre-given maximum input data are used as video input data.

4. The method according to claim 3, wherein said attenuation information is evaluated during a blanking time between two video frames.

5. The method according to claim 3, wherein component attenuation information is evaluated for each of the red, green and blue components of the adjusted video data, and the component attenuation information having the lowest level is used as said attenuation information.

6. The method according to claim 1, wherein said attenuation information is provided or evaluated for each frame of said video input data.

7. An apparatus for driving a plasma display panel, comprising:

a brightness or contrast control module for receiving video input data, for respectively adjusting the gain or the offset of the video input data and for outputting adjusted video data in front of a power management module, an attenuation data module for providing and evaluating an attenuation information representative of the attenuation provided by said brightness or contrast control module, a power measurement module for measuring a power level of said adjusted video data and providing a respective first power level information, a power level generating module for generating a second power level information on the basis of said first power level information and said attenuation information, a compensating module for changing the level of said adjusted input data of said brightness or contrast control module on the basis of the attenuation information and for outputting dynamic compensated video data, and a power management module for adjusting the number of sustain pulses per sub-field on the basis of said second power level information and driving said plasma display panel with said adjusted number of sustain pulses and said compensated video data.

8. The apparatus according to claim 7, wherein said attenuation data module includes a data generator for inputting pre-given maximum input data into said brightness or contrast control module and further including an attenuation evaluation module for evaluating an attenuation applied on said pre-given maximum input data when being adjusted in the brightness or contrast control module.

9. The apparatus according to claim 8, wherein said data generator is capable of providing pre-given maximum input data for each of the video components red, green and blue and said attenuation evaluation module is capable of evaluating for each of said components component attenuation information, wherein that component attenuation information having the lowest level is used as said attenuation information.

* * * * *